United States Patent [19]

Kao

[11] 4,272,006

[45] Jun. 9, 1981

[54] METHOD OF SOLDERING TUBE TO PLATE

[75] Inventor: Stephen S. T. Kao, Racine, Wis.

[73] Assignee: Modine Manufacturing Company, Racine, Wis.

[21] Appl. No.: 117,395

[22] Filed: Feb. 1, 1980

[51] Int. Cl.[3] ..... F28F 9/16

[52] U.S. Cl. ..... 228/183; 29/157.4; 165/79; 165/178; 228/245; 285/31; 285/192; 285/287

[58] Field of Search ..... 165/79, 178, DIG. 8; 29/157.4; 228/183, 245; 285/31, 189, 192, 287

[56] References Cited

U.S. PATENT DOCUMENTS

| | | | |
|---|---|---|---|
| 235,834 | 12/1880 | White | 29/157.4 |
| 2,073,778 | 3/1937 | Boerger | 165/79 |
| 2,229,207 | 1/1941 | Hansen | 165/79 |
| 2,752,129 | 6/1956 | Modine | 165/79 |
| 2,813,502 | 11/1957 | Drom | 228/249 |
| 2,961,062 | 11/1960 | Hunter et al. | 165/DIG. 8 |
| 3,245,465 | 4/1966 | Young | 29/157.4 X |
| 3,589,440 | 6/1971 | Friedrich | 165/178 |
| 3,734,175 | 5/1973 | Christensen | 29/157.4 |
| 4,023,611 | 5/1977 | Clemens et al. | 29/157.4 X |

FOREIGN PATENT DOCUMENTS

| | | | |
|---|---|---|---|
| 2009122 | 9/1970 | Fed. Rep. of Germany | 165/178 |
| 220286 | 9/1968 | U.S.S.R. | 29/157.4 |

*Primary Examiner*—Sheldon J. Richter

*Attorney, Agent, or Firm*—Wegner, Stellman, McCord, Wood & Dalton

[57] ABSTRACT

A method of making and the resulting heat exchanger in which there is provided a header plate having a tube receiving opening closely embracing the tube in the opening with a sheet of solder on at least one of the tube and plate adjacent to the opening together with a retainer wettable by the molten solder attached to the tube and plate and bearing against the solder to retain it in position. The assembly of tube, plate, retainer and solder is heated to a melting temperature for the solder with the result that the molten solder flows over the wettable retainer and into the space between the plate and tube by capillary attraction after which the solder is cooled to a solidifying temperature to form a solder joint uniting the tube and header.

1 Claim, 4 Drawing Figures

METHOD OF SOLDERING TUBE TO PLATE

BACKGROUND OF THE INVENTION

In producing header and tube heat exchangers wherein a tube is united to the header at an opening in the header the clearance varies over a wide range due to worn dies used in punching the opening and manufacturing deviations generally. Because of these manufacturing deviations the molten solder material often flows out of the joint space before it can become solid within the space.

The customary way of making a solder joint whether the solder material is a lead alloy or a brazing alloy is to melt the material to a molten condition and then dip the assembly of header, plate and tubes into the molten solder. When the solder is a brazing material the melting temperature for this material can be quite high such as from 1200°–2000° F. depending upon the type of brazing alloy used. Under these conditions it is difficult to get the alloy into the joint by a dipping process because of the heat requirements and accelerated oxidation problems due to this high temperature. Furthermore, in order to achieve such high temperatures, it is customary to use an oxyacetylene torch and a filler wire of the appropriate alloy. Although this results in a satisfactory joint, it requires considerable time and thus is relatively costly. Also, for alloys having a melting point up toward the top of this temperature range, it is preferred to conduct the joining with the molten solder in a controlled atmosphere such as an atmosphere of nitrogen to prevent oxidation.

SUMMARY OF THE INVENTION

A feature of this invention is to provide a method of joining a heat exchanger tube to a header plate comprising forming an assembly of header plate with a tube extending into an opening in the plate that closely embraces the tube and providing a sheet of solder on one or both of the tube and plate adjacent to the opening and held in place by a retainer which also serves as a reinforcement at the joint for holding the solder material in position preparatory to and during the melting of the solder so that molten solder will be drawn into the space between the tube and header plate by capillary attraction. Upon cooling the solder which has been transferred in the main from the space between the retainer and the header or tube or both resumes its solid state and provides the joint.

A novelty search resulted in the following U.S. Pat. Nos., none of which disclose the invention: 2,113,060; 2,371,823; 2,473,887; 2,525,087; 2,813,502; 2,959,844; 3,223,823; 3,245,465; 3,496,629; 3,589,440; 3,710,473; Re. 29,737; 3,750,747 and 3,797,087.

DESCRIPTION OF THE PREFERRED EMBODIMENTS

The terms "solder" and "solder material" used herein are generic to the dictionary definition of "a metal or metallic alloy used when melted to joint metallic surfaces". Brazing material, for example, is a solder and is defined as "a non-ferrous alloy that melts at a lower temperature than that of the metals being joined".

Figure 1:
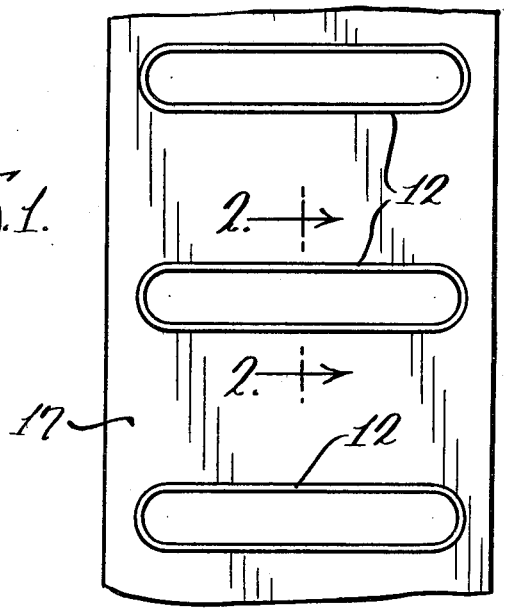
FIG. 1 is a fragmentary plan view illustrating one embodiment of the invention.
Figure 2:
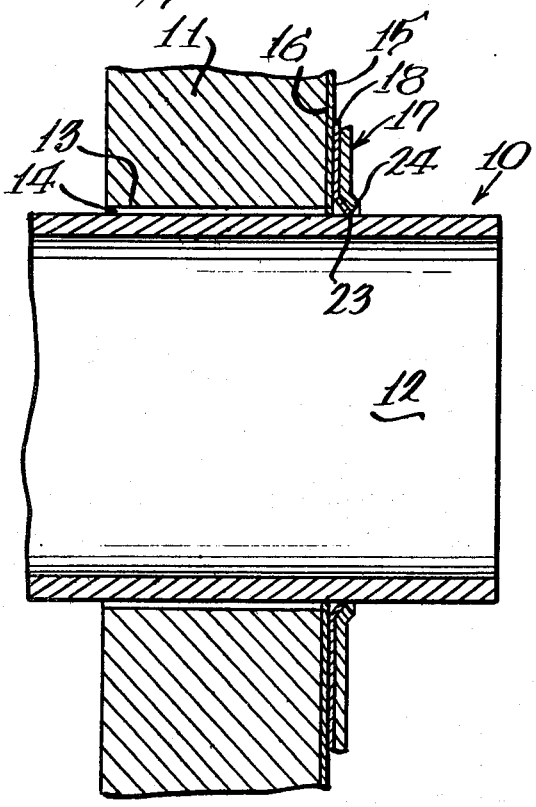
FIG. 2 is a fragmentary sectional view taken substantially along line 2—2 of FIG. 1 illustrating a step in the method of practicing the invention.
Figure 3:
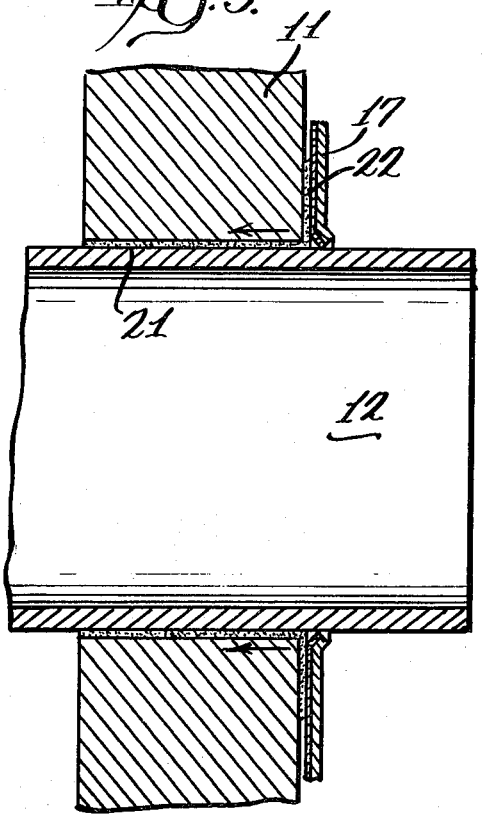
FIG. 3 is a view similar to FIG. 2 but illustrating a further step in the invention.

In the embodiment of FIGS. 1–3 the heat exchanger 10 comprises a header plate 11 and a plurality of tubes 12 extending through openings 13 therein that are so dimensioned as to provide spaces 14 between the plate 11 and tube 12. These openings 13 closely embrace each tube with the amount of space being exaggerated in FIGS. 2 and 3 for clarity of illustration.

In practicing the method of this invention the tubes 12 are located in the openings 13 and a sheet 15 of solder material which may be the usual lead based alloy or preferably a brazing alloy is positioned against a surface of the header plate 11.

Although in the illustrated embodiment of FIGS. 1–3 the sheet 15 is shown held against one face 16 of the header 11 and surrounding the tube 12 it could of course be placed around the tube 12 in the vicinity of the joint space 14 if desired.

The sheet 15 of solder material is held in place by a retainer 17. This retainer 17 as illustrated is in the form of a sheet having on the inner surface thereof a coating 18 so as to make the retainer 17 wettable by the molten solder material. This in this embodiment where the material is a copper based brazing material such as copper or a copper alloy such as brass this coating 18 may itself be of copper.

The retainer 17 serves to retain the solder material 18 in position regardless of what position the heat exchanger 10 assembly is placed in after this assembly has been prepared. Then the assembly as illustrated in FIG. 2 is heated to a temperature above the melting point of the solder material 15 but below the melting point of the constituent parts including the header and tube. As a result of this heating the solder 15 becomes molten and flows over the wettable surface 18 of the retainer 17 and into the joint space 14 by capillary action to provide the solder joint 21 as illustrated in FIG. 3.

Because less than all of the solder material sheet 15 will be so drawn by capillary action into the spaces 14 there will be a portion 22 that will remain between the retainer 17 and the header 11 to join the retainer 17 to the header with the result that in the final soldered assembly of FIG. 3 the retainer 17 will function as a reinforcement surrounding the joint 21.

As stated, the solder material 18 may be a brazing material such as copper or may be a copper alloy such as brass. The header 11 and the tubes 12 may be of any structural heat exchange material such as steel and particularly stainless steel. Aluminum can, of course, also be used and, if desired, the header plate 11 may be of one material such as steel or aluminum and the tubes 12 may be of another material such as copper or brass.

Figure 4:
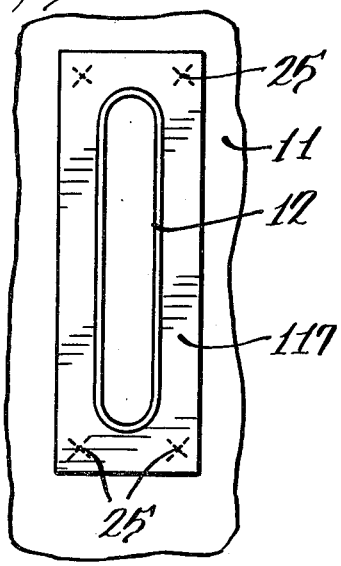
FIG. 4 is a view similar to FIG. 1 but illustrating a second embodiment of the invention.

In the embodiment of FIGS. 1–3 the retainer sheet 17 extends over the entire surface of the header 11. In the embodiment of FIG. 4, however, the same header plate 11 may be used along with the tubes 12 but here the retainer plates 117 are in the form of individual separated plates or sheets here being shown as being of rectangular structure surrounding the tubes 12.

The retainers 17 or 117 may be attached to the assembly by various ways to hold the retainers and solder sheet 15 in position. In the embodiment of FIGS. 2 and 3 this retention is provided by having a sharp edge 23 on an outwardly turned flange 24 of the retainer dug into or biting the outer portion of the tube 12 so as to resist slippage. If desired, the retainer may be held in position by spot welds as illustrated at 25 in FIG. 4.

These spot welds 25 are spaced apart and as shown in the FIG. 4 embodiment are located at the corners of the rectangular retainer 117. The assembly could also be held preparatory to the final soldering step by seam welds or the like.

Having described my invention as related to the embodiments shown in the accompanying drawings, it is my intention that the invention be not limited by any of the details of description, unless otherwise specified, but rather be construed broadly within its spirit and scope as set out in the appended claims.

I claim:

1. The method of joining a heat exchanger tube to a header plate, comprising: providing a header plate having a tube receiving opening in said plate closely embracing said tube when inserted in said opening; arranging a said heat exchanger tube in said opening; providing a sheet of solder on at least one of said tube and plate adjacent to said opening; attaching a retainer wettable by molten said solder to said tube or plate and bearing against said solder to retain it in position, said solder having a melting point less than the melting point of the header, tube and retainer; heating the resulting assembly of tube, plate, retainer and solder to a melting temperature for said solder whereby said molten solder flows over said retainer and into the space between the plate and tube by capillary attraction; and cooling the solder to a temperature less than the melting point of the solder to form a joint uniting said tube and header, said retainer being provided with an opening surrounding said tube, the opening being defined by a sharp edge engaging and slightly penetrating the surface of the tube for holding the retainer in position.

* * * * *